US011840376B2

(12) United States Patent
Taylor

(10) Patent No.: US 11,840,376 B2
(45) Date of Patent: Dec. 12, 2023

(54) SECURITY CONTAINER

(71) Applicant: Process4, Inc., Chagrin Falls, OH (US)

(72) Inventor: Curtis Taylor, Chagrin Falls, OH (US)

(73) Assignee: PROCESS4, INC., Chagrin Falls, OH (US)

( * ) Notice: Subject to any disclaimer, the term of this patent is extended or adjusted under 35 U.S.C. 154(b) by 0 days.

(21) Appl. No.: 17/743,829

(22) Filed: May 13, 2022

(65) Prior Publication Data

US 2022/0363441 A1 Nov. 17, 2022

Related U.S. Application Data

(60) Provisional application No. 63/188,018, filed on May 13, 2021.

(51) Int. Cl.

| | |
|---|---|
| ***B65D 55/02*** | (2006.01) |
| ***B65D 25/22*** | (2006.01) |
| ***A45C 13/00*** | (2006.01) |
| *A45C 11/32* | (2006.01) |
| *A45C 11/18* | (2006.01) |

(52) U.S. Cl.

CPC ..... *B65D 25/22* (2013.01); *A45C 13/00* (2013.01); *A45C 11/182* (2013.01); *A45C 11/32* (2013.01)

(58) Field of Classification Search

CPC .. E05B 73/0023; E05B 37/025; E05B 67/003; B65D 73/0064; B65D 75/566; B65D 55/14; B65D 25/22; A45C 11/182; A45C 11/32; A45C 13/18; A45C 2001/006

USPC ..... 220/770, 761, 768, 751; 206/1.5; 70/63

See application file for complete search history.

(56) References Cited

U.S. PATENT DOCUMENTS

| | | | | |
|---|---|---|---|---|
| 6,085,671 | A * | 7/2000 | Kerr | E05G 1/005 109/51 |
| 9,428,941 | B1 * | 8/2016 | Yang | E05B 67/063 |
| 2004/0074265 | A1 * | 4/2004 | Bruening | E05B 69/00 70/57.1 |

* cited by examiner

*Primary Examiner* — King M Chu

(74) *Attorney, Agent, or Firm* — Ulmer & Berne LLP; Brian E. Turung

(57) ABSTRACT

A security container that can be easily and securely connected to a fixed structure such as, but not limited to, a rod, pole, handle, latch, etc. such that the security container can be securely and easily connected and disconnected from the fixed structure.

18 Claims, 3 Drawing Sheets

SECURITY CONTAINER

The present disclosure claim priority on U.S. Provisional Patent Application No. 63/188,018; filed May 13, 2021, which is incorporated herein by reference.

The present disclosure pertains to a security container that can be easily and securely connected to a holding device such as, but not limited to, a rod, pole, handle, latch, etc. such that the security container can be securely and easily connected and disconnected from the holding device.

BACKGROUND

During travel, it can be desirable to secure a storage container to a fixed structure such as a pole, a closet rod, etc. There is currently no convenient type of traveling container that can be temporarily secured in a closet foe use by a traveler.

SUMMARY OF DISCLOSURE

The present disclosure pertains to a security container that can be easily and securely connected to a fixed structure such as, but not limited to, a closet rod, pole, leg of a room radiator, etc. such that the security container can be securely and easily connected and disconnected from the fixed structure.

In one non-limiting aspect of the disclosure, there is provided a security container that includes a container body having one or more interior cavities, one or more doors and/or drawers that are movable between an open and closed position, a locking arrangement that is configured to secure the one or more doors and/or drawers in a locked and closed position, and a securing arrangement used to releasably secure the container body a fixed structure (e.g., leg of a radiator, closet clothes handing pole, portion of a bed, portion of a desk, handle on a lockable drawer, fixed pole, fixed bracket or handle, etc.).

In another non-limiting aspect of the disclosure, the container body is configured to contain one or more items in an interior cavity of the container body. The container body can be formed for any type of durable material (e.g., plastic, metal, wood, composite material, ceramic, etc.). The size and shape of the container body are non-limiting. In one non-limiting arrangement, the volume of the container body is no more than 5 cubic feet (e.g., 0.01-5 cubic feet and all values and ranges therebetween), and is typically 0.03-1 cubic feet. The weight of the container body is generally no more than 20 lbs. (e.g., 0.1-20 lbs, and all values and ranges therebetween). In one non-limiting configuration, the container body a) has a cubic shape or rectangular cuboid, b) has a volume of 0.03-0.5 cubic feet, c) 5-100% (and all values and ranges therebetween) of the container body includes metal (e.g., stainless steel, aluminum, nickel alloy, titanium, etc.), and d) has a weight of no more than 5 lbs. (e.g., 0.2-5 lbs. and all values and ranges therebetween).

In another non-limiting aspect of the disclosure, the shape of the one or more interior cavities in the container body is non-limiting. The one or more interior cavities of the container body can optionally include one or more pockets, shelves, hoods, nooks, cavities, ledges, and/or drawers. These optional features can be used to organize and/or facilitate in the storage of items in the one or more interior cavities of the container. The one or more interior cavities of the container body can optionally include fabric walls, printed color walls, and/or cushioned walls.

In another non-limiting aspect of the disclosure, the security container optionally includes one or more doors so as to allow or deny access to the interior region of the interior cavity of the container body. The one or more doors can be connected to any region on the container body. The one or more doors can be optionally hingedly connected to the container body so as to move via one or more hinges between the open and closed positions. The one or more doors can be removably or irremovably connected to the container body. When two or door doors are connected to the container body, the doors can a) be connected on the same or different sides of the container body, and/or b) have the same or different size, shape and/or configuration. The material used to form the one or more doors can be the same or different material from the composition of the container body. In one non-limiting configuration, the security container includes a single door that is hingedly connected to the container body, and 5-100% (and all values and ranges therebetween) of the door is formed of the same material as the container body.

In another non-limiting aspect of the disclosure, the security container optionally includes one or more drawers that are movable between open and closed positions. The one or more drawers can be removably or irremovably connected to the container body. The security container can include a) both one or more drawers and one or more doors, b) only one or more drawers, or c) only one or more doors. When two or door drawers are used, the drawers can a) be positioned on the same or different sides of the container body, and/or b) have the same or different size, shape and/or configuration. The material used to form the one or more drawers can be the same or different material from the composition of the container body. In one non-limiting configuration, the security container includes one to four drawers, and 5-100% (and all values and ranges therebetween) of the drawers are formed of the same material as the container body.

In another non-limiting aspect of the disclosure, the locking arrangement, when used with the one or more doors and/or one or more drawers, is configured to secure the one or more doors and/or one or more drawers in a locked and closed position. When the one or more doors are in the locked and closed position, access to the interior region of the interior cavity of the container body is limited to prevented. When the one or more drawer are in the locked and closed position, access to the contents of the one or more drawers is limited to prevented. The type of locking arrangement is non-limiting (e.g., key lock, combination lock, biometric lock, electronic lock, wireless [e.g., Bluetooth, wifi, etc.] controlled lock, magnetic lock, RFID lock, etc.). When one or more wireless controlled locks are used, such locks can be locked and/or unlocked by a smart device (e.g., smart phone, tablet, computer, etc.) and/or by a device that can generate a wireless signal (e.g., key fab, etc.).

In another non-limiting aspect of the disclosure, the securing arrangement is configured such that it is a) partially or fully releasably connected to the container body, or b) is hingedly connected or otherwise movably connected to the container body. The material, type, size and configuration of the securing arrangement are non-limiting. In one non-limiting embodiment, material used to partially or fully form the securing arrangement includes solid metal, metal strands or fibers, durable manmade fibers (e.g., ultra-high molecular weight polyethylene fibers (UHMWPE), aramid fibers [e.g., Kevlar™, Nomex™ etc.], polybenzoxazole (PBO) fibers, polyarylate fibers [e.g., Vectran™ fiber, etc.], carbon fibers), ceramic materials, composite materials. The securing arrangement may or may not be flexible. One or both end portions of the securing arrangement can be configured to be releasably securable to the container body. In one non-limiting arrangement, one or both end portions of the securing arrangement are configured to be releasably securable to the interior of the interior cavity of the container body. In such an arrangement, one or both end portions of the securing arrangement can only be secured or detached from the container body by accessing a connection arrangement that is located in the interior cavity of the container body. As such, when the one or more doors and/or drawers are in the closed and locked position to prevent access to the interior cavity of the container body, the connection arrangement for the securing arrangement cannot be accessed. Thus once the securing arrangement is connected to the container body by the connection arrangement and the one or more doors and/or drawers are closed and locked, the securing arrangement cannot be detached from the container body. The type of connection arrangement that can be used is non-limiting (e.g., latch, hook, snap, clip, pin lock arrangement, hook and loop fastener, mushroom and stem connection arrangement, screw, clamp, any mechanical fastening arrangement, etc.). When the securing arrangement is connected to the container body, a portion of the securing arrangement extends outwardly from the container body. This outwardly extending portion of the securing arrangement extends outwardly from the container body can be used to wrap about and/or otherwise be connected to a fixed structure so as to secure the container body to the fixed structure.

In another non-limiting aspect of the disclosure, the securing arrangement can optionally have a U-shaped configuration. The two legs of the securing arrangement can optionally include a pin hole on the lower portion of each leg of the U-shape device. The pin can be configured to be inserted into one or both pin holes. The container body can optionally include one or more body slots that is configured to enable a portion of a leg to be inserted therein. After one or both legs are inserted into the body slots, the pin or other type of connection arrangement is inserted in the pin holes to thereby secure the securing arrangement to the container body.

In another non-limiting aspect of the disclosure, the securing arrangement can optionally include an insertion limiter (e.g., angled flange or other extension members, thicker portion, etc.) to limit the degree or amount that one or both legs of the securing arrangement into the one or more body slots in the container body. Once a portion of one or both of the legs of the securing arrangement is inserted into the container body, the connection arrangement in the form of a pin or other configuration is inserted through the one or more pin holes to secure securing arrangement to the container body.

Other aspects, advantages, and novel features of the present disclosure will become apparent from the following detailed description of the disclosure when considered in conjunction with the accompanying drawings.

BRIEF DESCRIPTION OF THE DRAWINGS

Reference may now be made to the drawings, which illustrate various embodiments that the disclosure may take in physical form and in certain parts and arrangement of parts wherein.

DETAILED DESCRIPTION

Figure 1:
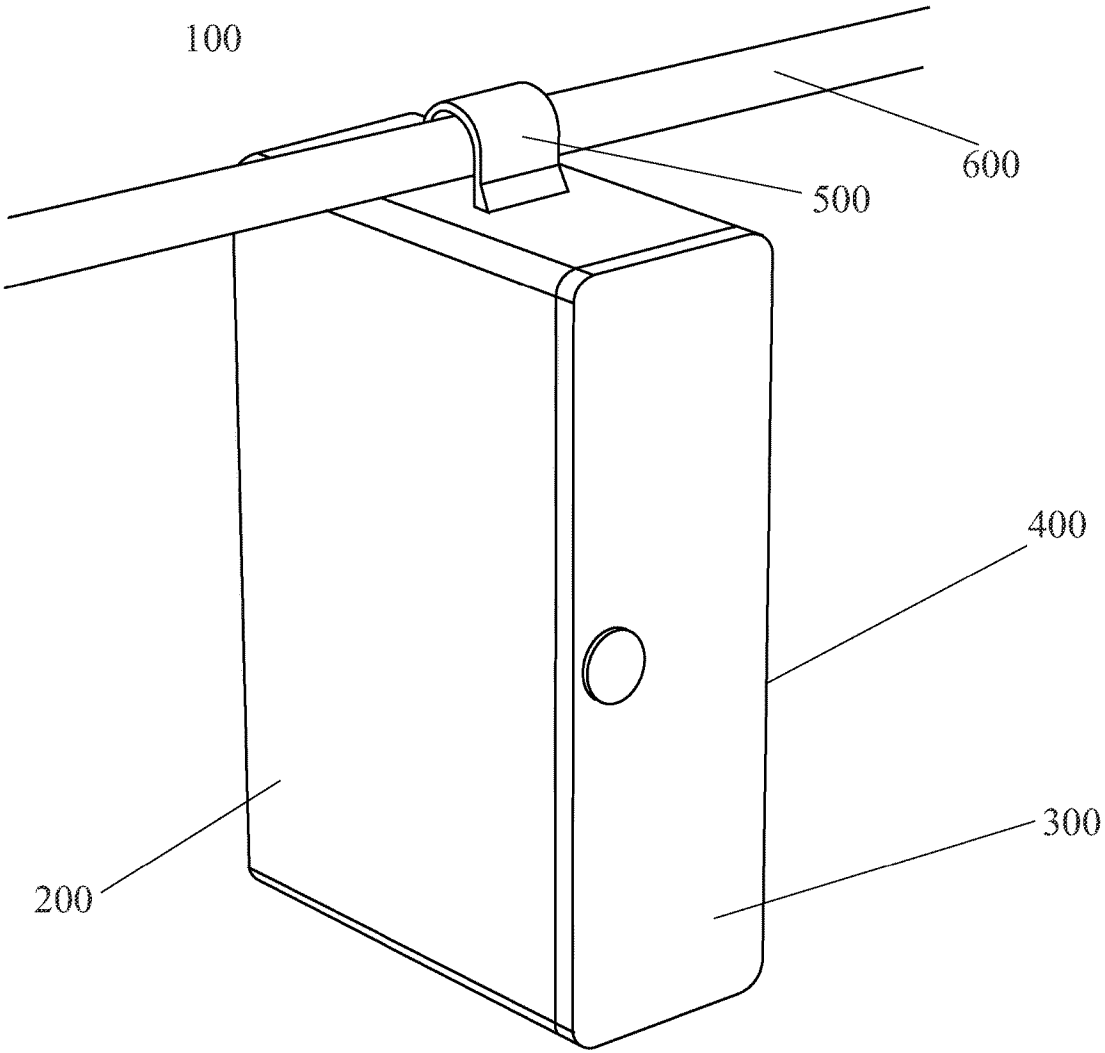
FIG. 1 is a front elevation view of a non-limiting embodiment of the present disclosure which shows a security container that can be securely connected to and detached from a closet pole.

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Figure 2:
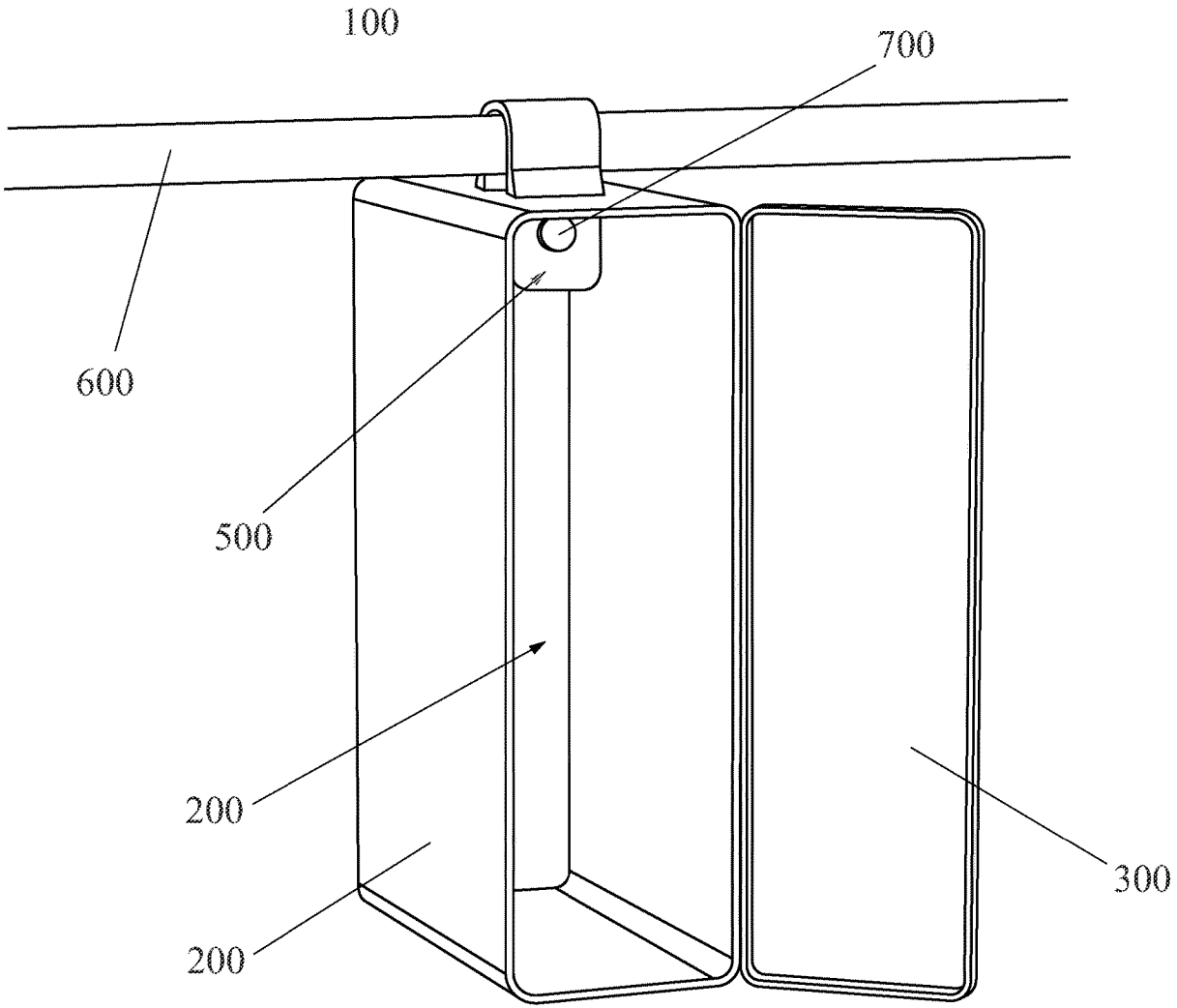
FIG. 2 is a front elevation of the security container of FIG. 1 wherein the door to the security container is open.
Figure 3:
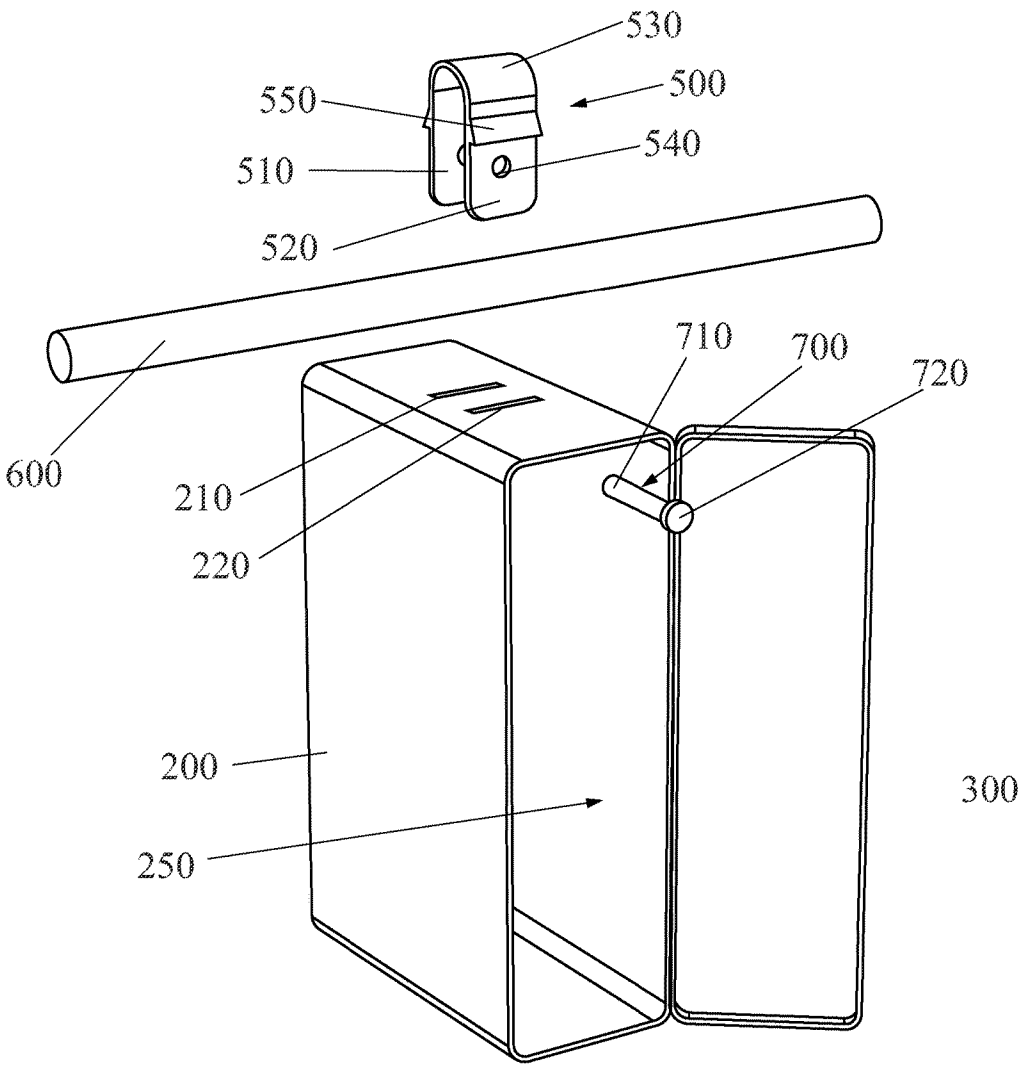
FIG. 3 is an exploded view of the security container of FIG. 1.

Referring now to the drawings, wherein the showings are for the purpose of illustrating non-limiting embodiments of the disclosure only and not for the purpose of limiting the same, FIGS. 1-3 illustrate a non-limiting embodiment of the present disclosure directed to security container. FIGS. 1-2 provide non-limiting features of the security container. FIG. 1 illustrates the security container securely connected to a fixture such as, but not limited to, a closet rod.

FIGS. 1-3 illustrate one non-limiting securing arrangement and the non-limiting pin type connection arrangement that can be used to secure the end portions of the securing arrangement in the interior cavity of the container body.

As illustrated in FIG. 1, the security container 100 includes a container body 200, a door 300 that is connected to the container body 200, a locking arrangement 400 that is used to secure in the door 300 in a locked-closed position, and a securing arrangement 500 that is used to releasably secure that container body 200 to a fixed structure 600 such as, but not limited to, a mounted closet pole 600.

The container body 200 is illustrated as having a rectangular cuboid shape. As can be appreciated, the container body 200 can have other shapes. The shape and size of the container body can optionally be configured to be thin to facilitate in fitting the container body 200 between other hanging items on the closet pole 600 in the closet when the security container 100 is releasably connected to a closet pole. The security container 100 can be configured to be positioned on at or near eye-level when the security container 100 is releasably connected to a closet pole. In one non-limiting embodiment, the height of the container body is about 3-20 inches in height (and all values and ranges therebetween), 2-10 inches in width (and all values and ranges therebetween), and 3-20 inches deep (and all values and ranges therebetween). In one non-limiting configuration, the height of the container body is about 5-12 inches in height, 2-5 inches in width, and 5-12 deep. In one non-limiting embodiment, container body is made of a metal (e.g., stainless steel, aluminum, etc.), and a volume of the container body is about 0.03-1 cubic feet, and the container body has a weight of less than 15 lbs. so that the security container can be easily packed and transported in a carry-on suitcase or a standard backpack.

The door 300 can be movably connected to the container body 200 by various arrangement (e.g., hinge, etc.) so that the door 300 can move between an open and closed position. FIG. 1 illustrates the door 300 in the closed position and FIG. 2 is illustrated in the open position.

A locking arrangement 400 is used to lock the door 300 in a locked position. The type of locking arrangement 400 used is non-limiting (e.g., key, combination, etc.). The location of the locking arrangement 400 on the security container 100 is non-limiting (e.g., container body 200 and/or door 300). As illustrated in FIG. 2, the locking arrangement 400 is located on the door 300.

As illustrated in FIG. 1, the container body 200 includes an interior cavity 250 wherein one or more items (e.g., keys, wallet, billfold, passports, money, credit cards, documents, glasses, etc.). The volume of the interior cavity 250 is generally at least 2% (e.g., 2-60% and all values and ranges there between) less than the volume of the container body 200.

The securing arrangement 500 is illustrated as being a generally U-shaped device; however, many other shapes can be used (e.g., V-shaped, C-shaped, etc.). The securing arrangement includes two legs 510, 520 and a curved or flat top portion 530 that is connected to the two legs. In one non-limiting configuration, the legs 510, 520 are generally parallel to one another along 20%-100% (and all values and ranges therebetween) the longitudinal length of the legs 510, 520. In another non-limiting configuration, the longitudinal length, width, thickness and shape of legs 510, 520 is generally the same; however, this is not required. As illustrated in FIG. 3, the thickness of each of the legs is less than the width and longitudinal length of each of the legs, and the width of each of the legs is less than the longitudinal length of ach of the legs. In one non-limiting configuration, the longitudinal length of each leg is 1-5 inches (and all values and ranges therebetween), the maximum spacing of the legs from one another is 1~4 inches (and all values and ranges therebetween), and the maximum width of each of the legs is 1~4 inches (and all values and ranges therebetween).

The lower portion of one or both of the legs includes a pin opening 540 that is configured to receive a portion of a connector pin 700. The shape of the pin openings is non-limiting. As illustrated in FIG. 3, the pin opening is generally circular.

As illustrated in FIGS. 1 and 2, the top portion of the securing arrangement is configured to at least partially encircle a fixed structure 600 and entrap a portion of the fixed structure 600 between the top portion of the securing arrangement and the container body 200 when the security container 100 is removably connected to the fixed structure 600.

Positioned above one or both of the pin openings 540 in each leg 510, 520 is an optional insert limiter 550. The insert limiter (e.g., angled flange or other extension members, thicker portion, etc.) is configured to limit the degree or amount that the legs 510, 520 of the securing arrangement 500 can be inserted into the container body 200. As illustrated in FIG. 3, the inert limiter 550 is a flange that extends outwardly from a surface on one or both of the legs 510, 520. The insert limiter 550 is generally spaced from a bottom end of the legs of the securing arrangement, and is optionally spaced from the top portion 530 of the securing arrangement. In one non-limiting arrangement, the insert limiter 550 is position on one or both of the legs of the securing arrangement. The thickness of the insert limiter is generally 5%-1000% (and all values and ranges therebeteween) the thickness of at least one of legs 510, 520. In one non-limiting configuration, the thickness of the insert limiter is 20%-150% the thickness of at least one of the legs. The width of the insert limiter can be 1%-100% (and all values and ranges therebetween) the width of at least one of legs 510, 520. In one non-limiting configuration, width of the insert limiter is 60-100% the width of at least one of legs 510, 520. The longitudinal length of the insert limiter along the longitudinal length of the legs 510, 520 is generally 2%-70% (and all values and ranges therebetween) the longitudinal length of at least one of legs 510, 520. In one non-limiting configuration, the longitudinal length of the insert limiter along the longitudinal length of the legs 510, 520 is generally 5%-30% the longitudinal length of at least one of legs 510, 520. The insert limiter 550 can optionally have a sloped configuration as illustrated in FIG. 3. In such optional configuration, the bottom portion of the insert limiter 550 has a greater thickness than the top portion of the inter limiter 550. The bottom surface of the insert limiter 550 that is configuration to engage an outer surface of the container body 200 when the securing arrangement 500 is positioned in the container boy 200 is generally a flat planar surface; however, this is not required. As illustrated in FIGS. 1-3, the insert limiter is located on the front face and/or the back face of one or both legs. However, it can be appreciated, that the insert limiter can also or alternatively located on one or both sides of one or both legs.

As illustrated in FIG. 2, a lower portion of the legs 510, 520 of the securing arrangement 500 is configured to be inserted into one or more body slots 210, 220 in container body 200. The one or more body slots are sized, configured and spaced from one another to enable the legs 510, 520 to be at least partially inserted through the body slots.

In one non-limiting configuration, the width of a body slot is 100-150% (and all values and ranges therebetween) the thickness of at least one or each of the legs. In another non-limiting configuration, the longitudinal length of a body slot is 100-150% (and all values and ranges therebetween) the width of at least one or each of the legs. Such a non-limiting configuration allows for the legs to be inserted into the body slots, and limit access to the interior of the container body when the securing arrangement is releasably connected to the container body. The location of the one or more body slots 210, 220 on the container body 200 is non-limiting. As illustrated in FIGS. 2 and 3, the body slots 210, 220 are located on the top of the container body 200. The body slots can have the same size, length and configuration; however, this is not required. Generally, the body slots are spaced from one another. Generally, the body slots are spaced from the edges of the container body. Generally, the spacing of the body slots is the same or very similar to the spacing of the legs on the securing arrangement to facilitate in the insertion and removal of the securing arrangement form the container body. Generally, the body slots are positioned parallel to one another. The insert limiter 550, when used, limits the amount of the one or more legs that can be inserted through the body slots 210, 220.

Once the lower portions of the legs 510, 520 are sufficiently inserted through the body slots 210, 220, the securing arrangement 500 can be releasably connected to the container body by inserting a connector pin 700 partially or fully through the pin openings 540 in legs 510, 520. The configuration of the connector pin is non-limiting. As illustrated in FIG. 3, the connector pin 700 includes a head portion 710 and a body portion 720. The shape of the head portion 710 and the body portion 720 is non-limiting. As illustrated in FIG. 3, the body portion is generally rod-shaped and the had portion is generally cylinder shaped. The longitudinal length of the body portion is generally greater than the longitudinal length of the head portion. A maximum cross-sectional area of the head portion 710 can optionally be greater than all or a portion of the body portion 720 along the longitudinal length of the body portion 720. In such non-limiting arrangement, the larger cross-sectional area of the head portion 710 can be such to prevent the head portion from being inserted fully through at least one or both of the pin openings 540. In one non-limiting arrangement, the larger cross-sectional area of the head portion 710 is such to prevent 80-100% of the head portion from being inserted fully through at least one or both of the pin openings 540. The longitudinal length of the body portion 720 is generally equal to or greater than the distance between the pin openings 540 on legs 510, 520.

As illustrated in FIG. 2, the connector pin is inserted through the pin openings 540 on both legs 510, 520 thereby releasably securing the securing arrangement 500 to the container body 200. When the securing arrangement 500 is to be disconnected from the container body 200, the connector pin 700 is simply removed from the pin openings 540 on legs 510, 520, and thereafter the securing arrangement 500 can be removed from the body slots 210, 220.

As illustrated in FIGS. 1 and 2, the upper portion of the securing arrangement 500 extends outwardly from the container body 200 when releasably secured to the container body 200.

When the security container 100 is to be secured to a fixed structure 600 such as a closet hanger pole that is permanently mounted in a closet, a user places the top portion 530 of the securing arrangement 500 on the fixed structure 600 as illustrated in FIG. 2. Thereafter, the bottom portion of the legs 510, 520 are inserted through the body slots 210, 220 on the container body. Thereafter, the connector pin is at least partially inserted through the pin openings 540 on the legs 510, 520 thereby removably securing the securing arrangement 500 to the container body 200, and also removably securing the container body to the fix structure. The placement of the connector pin 700 in the pin openings prevents the legs 510, 520 form being removed form the body slots 210, 220 on the container body 200.

A user can optionally place one or more items in the interior cavity 250 of the container body. The door 300 can be moved to the closed position and the locking arrangement 400 can be used to lock the door 300 in the locked position. When the door is in the closed position and locked, access to connector pin is prevented, thus the securing arrangement cannot be separated from the container body and the container body cannot be removed from the fixed structure 600. The security container 100 thereby functions as a security box or container that a user can temporarily mount in a closet, such as a hotel closet while the user is traveling. When the user decides to remove the securing container 100 from the fixed structure, the user simply opens the door and removes the connector pin 700 from the legs 510, 520 of the securing arrangement 500. Thereafter, the securing arrangement 500 can be separated from the container body 200 and the securing arrangement 500 is removed from the fixed structure 600.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the preferred embodiments. These and other modifications of the preferred embodiments as well as other embodiments of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed:

1. A security container comprising a container body that includes an interior cavity, a door that is connected to the container body and is movable between an open and closed position, a locking arrangement that is configured to secure said door in a locked and closed position, a securing arrangement used to releasably secure said container body to a fixed structure, and a securing device; said container body includes a first body slot; said securing arrangement includes a first leg configured to be insertable through said first body slot; said first leg includes a first connector configured to removably receive said securing device; said first connector includes a first opening; said securing device includes a pin; said pin having a head and a body portion; said body portion configured to pass through said first opening; said head having a shape and size that prevents said head from fully passing through said first opening.

2. The security container as defined in claim 1, wherein said container body includes a second body slot spaced from said first body slot; said securing arrangement includes a second leg configured to be insertable through said second body slot; said second leg includes a second connector configured to removably receive said securing device.

3. The security device as defined in claim 1, wherein said first leg includes a first insertion limiter having a size and configuration that prevents said first insertion limiter from passing fully through said first body slot.

4. The security device as defined in claim 2, wherein said first leg includes a first insertion limiter having a size and configuration that prevents said first insertion limiter from pass fully through said first body slot, said second leg includes a second insertion limiter having a size and configuration that prevents said second insertion limiter from passing fully through said second body slot.

5. The security device as defined in claim 4, wherein said second leg includes a second connector; said second connector includes a second opening; said body portion configured to pass through said second opening; said head having a shape and size that prevents said head from fully passing through said second opening.

6. A method for securing an item in a fixed structure comprising:

a. providing a security container; said security container including a container body that includes an interior cavity, a door that is connected to the container body and is movable between an open and closed position, a locking arrangement that is configured to secure said door in a locked and closed position, a securing arrangement used to releasably secure said container body to a fixed structure, and a securing device; said container body includes a first body slot; said securing arrangement includes a first leg configured to be insertable through said first body slot; said first leg includes a first connector configured to removably receive said securing device; said first connector includes a first opening; said securing device includes a pin; said pin having a head and a body portion; said body portion configured to pass through said first opening; said head having a shape and size that prevents said head from fully passing through said first opening;

b. positioning a portion of said securing arrangement about said fixed structure;

c. releasably securing said container body to said securing arrangement such that a portion of said fixed arrangement is entrapped between said securing arrangement and said container body;

d. placing said item in said interior cavity;

e. moving said door to said closed position and locking said door in said closed position by said locking arrangement.

7. The method as defined in claim 6, wherein said container body includes a second body slot spaced from said first body slot; said securing arrangement includes a second leg configured to be insertable through said second body slot; said second leg includes a second connector configured to removably receive said securing device.

8. The method as defined in claim 6, wherein said first leg includes a first insertion limiter having a size and configuration that prevents said first insertion limiter from passing fully through said first body slot.

9. The method as defined in claim 7, wherein said first leg includes a first insertion limiter having a size and configuration that prevents said first insertion limiter from pass fully through said first body slot, said second leg includes a second insertion limiter having a size and configuration that prevents said second insertion limiter from passing fully through said second body slot.

10. The method as defined in claim 9, wherein said second leg includes a second connector; said second connector includes a second opening; said body portion configured to pass through said first opening and said second opening; said head having a shape and size that prevents said head from fully passing through said second opening.

11. A security container comprising a container body that includes an interior cavity, a door that is connected to said container body and is movable between an open and closed position and is configured to allow access to said interior cavity when in said open position and to prevent access to said interior cavity when in said closed position, a locking arrangement that is configured to secure said door in a locked position when said door is in said closed position, a securing arrangement that is used to releasably secure said container body to a fixed structure, and a securing device; said container body includes a first body slot; said securing arrangement includes a first leg that is configured to be insertable through said first body slot and into said interior cavity;

said first leg includes a first connector that is configured to removably receive said securing device when said first connector and said securing device are located in said interior cavity; said securing device is configured to be inaccessible when said door is in said closed position; said securing device is configured to be irremovable from said first connector when said door is in said closed position; said first leg includes a first insertion limiter that is configured to engage a top surface of said body when said first leg is at least partially inserted through said first body slot; said first insertion limiter has a size and configuration that prevents said first insertion limiter from passing fully through said first body slot.

12. The security device as defined in claim 11, wherein said first connector includes a first opening; said securing device includes a pin; said pin has a head and a body portion; said body portion is configured to pass through said first opening; said head has a shape and size that prevents said head from fully passing through said first opening.

13. The security container as defined in claim 11, wherein said container body includes a second body slot that is spaced from said first body slot; said securing arrangement includes a second leg that is configured to be insertable through said second body slot and into said interior cavity; said second leg includes a second connector that is configured to removably receive said securing device.

14. The security container as defined in claim 12, wherein said container body includes a second body slot that is spaced from said first body slot; said securing arrangement includes a second leg that is configured to be insertable through said second body slot and into said interior cavity; said second leg includes a second connector that is configured to removably receive said securing device.

15. The security device as defined in claim 14, wherein said second leg include a second insertion limiter that is configured to engage said top surface of said body when said second leg is at least partially inserted through said second body slot; said second insertion limiter has a size and configuration that prevents said second insertion limiter from passing fully through said first body slot.

16. The security device as defined in claim 15, wherein said first and second legs and said first and second insertion limiters have the same shape and size.

17. The security device as defined in claim 14, wherein said second leg includes a second connector; said second connector includes a second opening; said body portion is configured to pass through said second opening; said head has a shape and size that prevents said head from fully passing through said second opening.

18. The security device as defined in claim 15, wherein said second leg includes a second connector; said second connector includes a second opening; said body portion is configured to pass through said second opening; said head has a shape and size that prevents said head from fully passing through said second opening.

* * * * *